US006223363B1

(12) United States Patent
Sumlin

(10) Patent No.: US 6,223,363 B1
(45) Date of Patent: May 1, 2001

(54) BUNK BED ASSEMBLY

(76) Inventor: Rickie F. Sumlin, P.O. Box 632, Hawkinsvlle, GA (US) 31036

( * ) Notice: Subject to any disclaimer, the term of this patent is extended or adjusted under 35 U.S.C. 154(b) by 0 days.

(21) Appl. No.: 09/506,568

(22) Filed: Feb. 18, 2000

(51) Int. Cl.[7] ..... A47C 19/20
(52) U.S. Cl. ..... 5/9.1; 5/8
(58) Field of Search ..... 5/9.1, 8; 105/316; 244/118.6; 114/192, 193; D6/384

(56) References Cited

U.S. PATENT DOCUMENTS

D. 379,877 6/1997 Tilley .
2,853,716 9/1958 Sevcik .
4,686,726 8/1987 Dunfee .
4,947,298 8/1990 Stephen .
5,555,654 9/1996 Hermann .
5,572,751 11/1996 Brandt .

*Primary Examiner*—Terry Lee Melius
*Assistant Examiner*—Frederick Conley

(57) ABSTRACT

A bunk bed assembly for providing a place for people to sleep. The bunk bed assembly includes a plurality of generally vertically extending elongate columns that are spaced apart and oriented in a generally rectangular configuration. Each of the columns has upper and lower ends and a transparent peripheral sidewall extending between the ends. The peripheral sidewall of each of the columns defines a bore through the column. A pair of spaced apart upper and lower bunks extend between the columns.

15 Claims, 3 Drawing Sheets

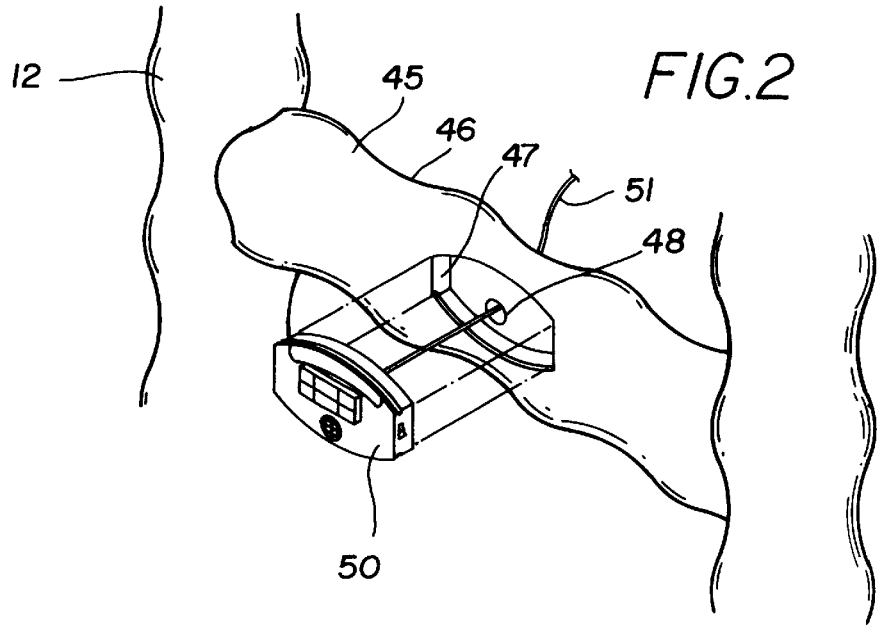
FIG.2
FIG.3
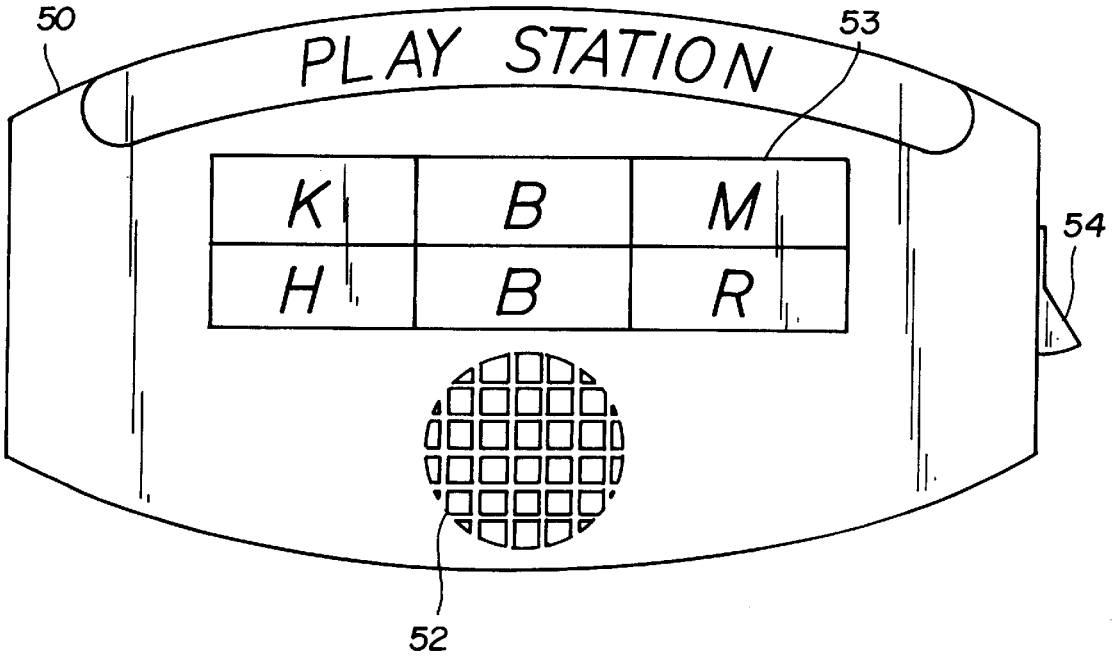

30
32
31
33
34
35
36
16
24
25
26

42
40
43
41
44
13
12

BUNK BED ASSEMBLY

BACKGROUND OF THE INVENTION

1. Field of the Invention

The present invention relates to beds and more particularly pertains to a new bunk bed assembly for providing a place for people to sleep.

2. Description of the Prior Art

The use of beds is known in the prior art. More specifically, beds heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,947,298; U.S. Pat. No. 2,853,716; U.S. Pat. No. Des. 379,877; U.S. Pat. No. 5,572,751; U.S. Pat. No. 5,555,654; and U.S. Pat. No. 4,686,726.

While these devices fulfill their respective, particular objectives and requirements, the aforementioned patents do not disclose a new bunk bed assembly. The inventive device includes a plurality of generally vertically extending elongate columns that are spaced apart and oriented in a generally rectangular configuration. Each of the columns has upper and lower ends and a transparent peripheral sidewall extending between the ends. The peripheral sidewall of each of the columns defines a bore through the column. A pair of spaced apart upper and lower bunks extend between the columns.

In these respects, the bunk bed assembly according to the present invention substantially departs from the conventional concepts and designs of the prior art, and in so doing provides an apparatus primarily developed for the purpose of providing a place for people to sleep.

SUMMARY OF THE INVENTION

In view of the foregoing disadvantages inherent in the known types of beds now present in the prior art, the present invention provides a new bunk bed assembly construction wherein the same can be utilized for providing a place for people to sleep.

The general purpose of the present invention, which will be described subsequently in greater detail, is to provide a new bunk bed assembly apparatus and method which has many of the advantages of the beds mentioned heretofore and many novel features that result in a new bunk bed assembly which is not anticipated, rendered obvious, suggested, or even implied by any of the prior art beds, either alone or in any combination thereof.

To attain this, the present invention generally comprises a plurality of generally vertically extending elongate columns that are spaced apart and oriented in a generally rectangular configuration. Each of the columns has upper and lower ends and a transparent peripheral sidewall extending between the ends. The peripheral sidewall of each of the columns defines a bore through the column. A pair of spaced apart upper and lower bunks extend between the columns.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bunk bed assembly apparatus and method which has many of the advantages of the beds mentioned heretofore and many novel features that result in a new bunk bed assembly which is not anticipated, rendered obvious, suggested, or even implied by any of the prior art beds, either alone or in any combination thereof.

It is another object of the present invention to provide a new bunk bed assembly which may be easily and efficiently manufactured and marketed.

It is a further object of the present invention to provide a new bunk bed assembly which is of a durable and reliable construction.

An even further object of the present invention is to provide a new bunk bed assembly which is susceptible of a low cost of manufacture with regard to both materials and labor, and which accordingly is then susceptible of low prices of sale to the consuming public, thereby making such bunk bed assembly economically available to the buying public.

Still yet another object of the present invention is to provide a new bunk bed assembly which provides in the apparatuses and methods of the prior art some of the advantages thereof, while simultaneously overcoming some of the disadvantages normally associated therewith.

Still another object of the present invention is to provide a new bunk bed assembly for providing a place for people to sleep.

Yet another object of the present invention is to provide a new bunk bed assembly which includes a plurality of generally vertically extending elongate columns that are spaced apart and oriented in a generally rectangular configuration. Each of the columns has upper and lower ends and a transparent peripheral sidewall extending between the ends. The peripheral sidewall of each of the columns defines a bore through the column. A pair of spaced apart upper and lower bunks extend between the columns.

Still yet another object of the present invention is to provide a new bunk bed assembly that entertains children.

Even still another object of the present invention is to provide a new bunk bed assembly that has at least one glowing light that may mesmerize children, causing them to fall asleep faster.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic detailed perspective view of the present invention.

FIG. 3 is a schematic side view of a play station of the present invention.

DESCRIPTION OF THE PREFERRED EMBODIMENT

Figure 1:
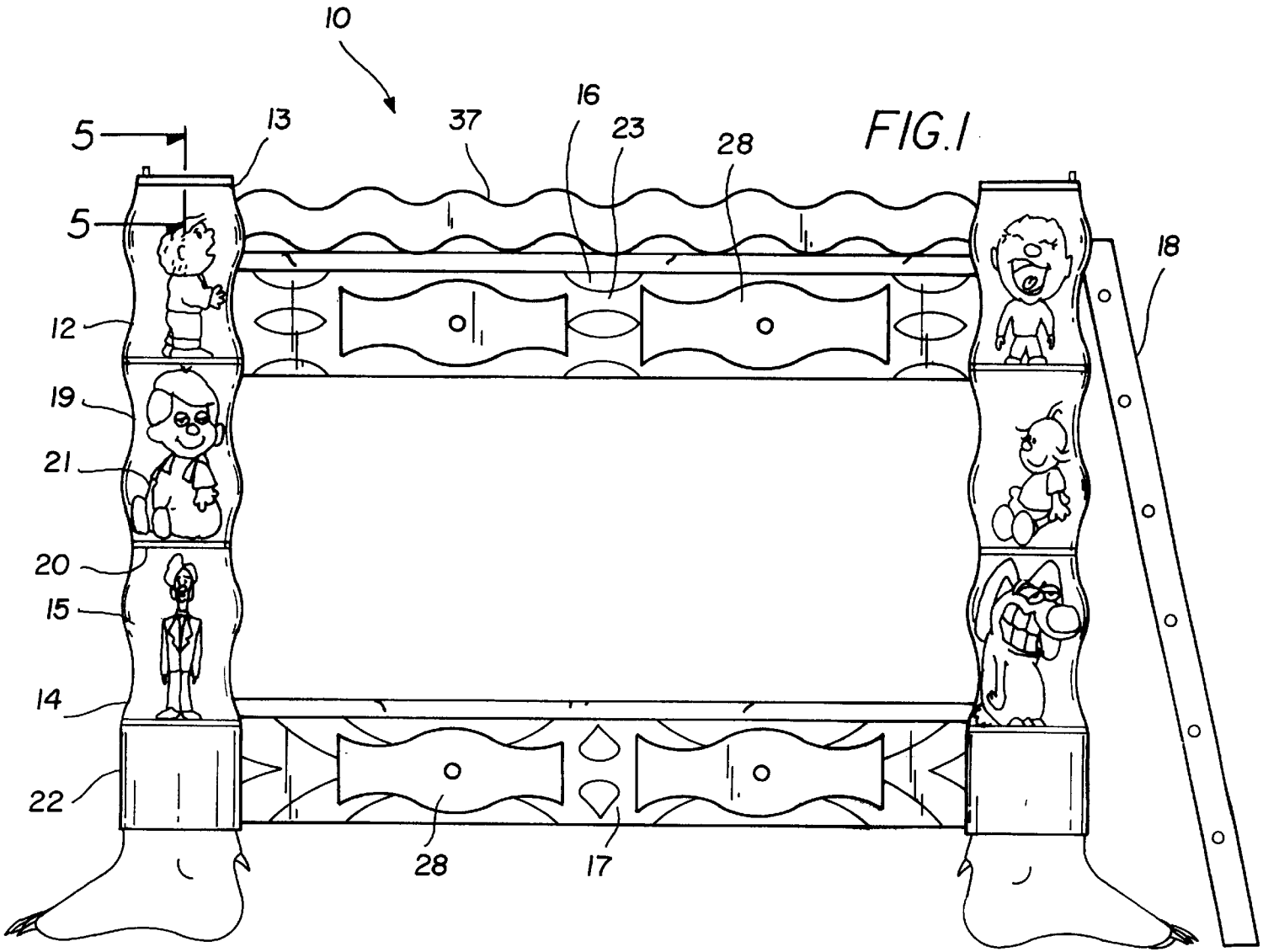
FIG. 1 is a schematic side view of a new bunk bed assembly according to the present invention.
Figure 4:
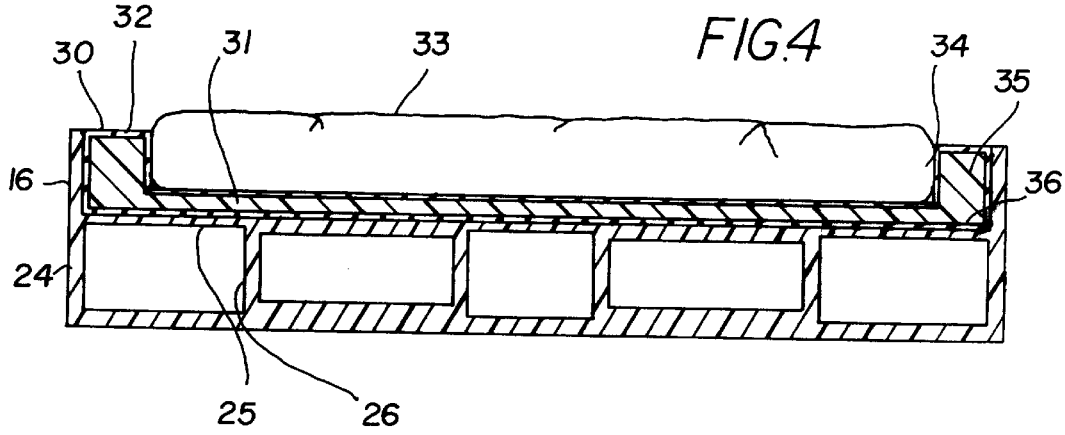
FIG. 4 is a schematic partial cross sectional view of the present invention.
Figure 5:
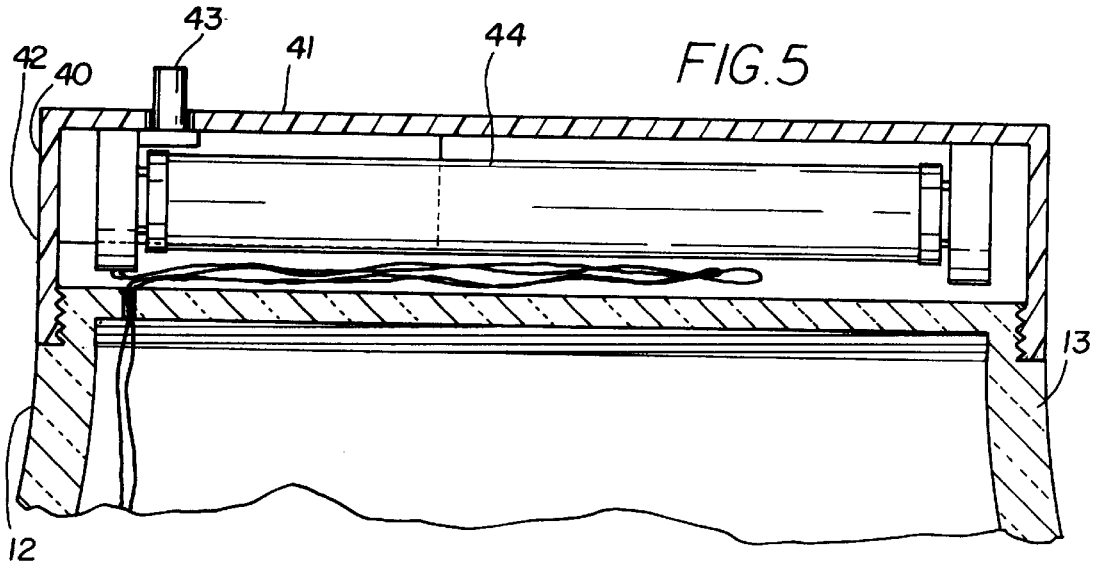
FIG. 5 is a schematic cross sectional view of the present invention taken from line 5—5 of FIG. 1.

With reference now to the drawings, and in particular to FIGS. 1 through 5 thereof, a new bunk bed assembly embodying the principles and concepts of the present invention and generally designated by the reference numeral 10 will be described.

As best illustrated in FIGS. 1 through 5, the bunk bed assembly 10 generally comprises a plurality of generally vertically extending elongate columns 12 that are spaced apart and oriented in a generally rectangular configuration. Each of the columns has upper and lower ends 13,14 and a transparent peripheral sidewall 15 extending between the ends. The peripheral sidewall of each of the columns defines a bore through the column. A pair of spaced apart upper and lower bunks 16,17 extend between the columns.

Preferably, a ladder 18 is coupled to the upper bunk.

Also preferably, each of the columns is generally cylindrical and may be made of molded acrylic or similar material, but should be strong enough to absorb the impact of a child striking a column with a full body blow.

Preferably, the peripheral sidewall of each of the columns has a plurality of equally spaced shallow annular recessions 19 positioned between the ends of the column. Also preferably, each of the columns has a plurality of spaced apart shelves 20 disposed in the bore thereof. Each of the columns has a plurality of stuffed dolls 21 therein resting on the shelves. The dolls are visible through the transparent peripheral sidewalls. Each of the columns may also have a generally cylindrical base portion 22 extending from the lower end thereof.

Preferably, each of the bunks is generally rectangular and has a pair of opposite sides 23, a pair of ends 24 extending between the sides, and a support panel 25 extending between the sides and ends of the bunk. Each of the support panels is positioned between upper and lower edges of the sides and ends of the associated bunk.

More preferably, each of the bunks has a plurality of cross members 26 extending between the sides of the bunks. The cross members abut a lower surface of the support panel of the associated bunk.

Preferably, one of the sides of each of the bunks has a pair of generally rectangular slots (not shown) therethrough. A plurality of drawers 28 slidably extend through the slots of the sides of the bunks and between an adjacent pair of the cross members of the bunks.

Also preferably, a pair of mattress housings 30 rest on the support panels. Each of the mattress housings has a base panel 31 and a peripheral flange 32 upwardly extending from the base panel. A pair of mattresses 33 rest on the base panels of the mattress housings. Ideally, the peripheral flanges extend around a lower ⅔ of a side edge 34 of each of the mattresses.

Ideally, each of the mattress housings comprises a light resilient polystyrene plastic inner portion 35 such as the type marketed under the trademark STYROFOAM so that it will have light weight and will give a little when a person applies pressure to the mattress. Most ideally, each of the mattress housings has a rubber outer covering 36 to prevent children from tearing or biting the polystyrene plastic inner portion.

Preferably, an elongate bunk rail 37 extends between the upper ends of a pair of the columns adjacent one of the sides of the upper bunk. More preferably, the bunk rail is wavy. Ideally, the bunk rail has a resiliently deformable rubber coating for safety.

Also preferably, a plurality of translucent light housings 40 each have a top panel 41 and a perimeter sidewall 42 downwardly extending from the top panel. The perimeter sidewalls are detachably coupled such as by being threadedly or frictionally coupled to the upper ends of the columns.

Ideally, each of the top panels of the light housings has a switch 43 extending through it which is in electrical communication with a power source. Most ideally, each of the switches are of the push button type.

Also ideally, each of the light housings has a light bulb 44 disposed therein. Each of the light bulbs is in communication with the switch of the associated light housing. Alternatively, each of the light bulbs is electrically connected to a single switch. Most ideally, each of the light bulbs comprises a fluorescent light so that the light passing through the light housings appears to glow.

Preferably, a plurality of support members 45 extend between adjacent columns positioned towards the ends of the bunks. More preferably, each of the support members has a plurality of equally spaced shallow annular recessions 46 positioned between opposite ends of the support member.

Also preferably, one of the support members has a depression 47 therein and an aperture 48 extending through the support member and positioned in the depression. An entertainment device 50 is removably disposed in the depression of the support member. A power cord 51 extends through the aperture of the support member. The entertainment device is in electrical communication with the power cord. Optionally, the entertainment device may be battery powered.

More preferably, the entertainment device has a voice synthesizer (not shown) housed internally thereof and a speaker 52 in communication with the voice synthesizer.

The voice synthesizer and speaker emit a plurality of prerecorded audio messages in a human voice or the voice of an entertainment figure or cartoon.

Ideally, the entertainment device has a plurality of buttons 53 in communication with the voice synthesizer. Each of the buttons corresponds to a unique prerecorded message. One of the prerecorded messages is emitted when the associated button is depressed. Also ideally, the entertainment device has a power switch 54 that is electrically connected to the power cord and the voice synthesizer. Most ideally, the depression of the support member faces an adjacent the bunk so that the entertainment device is easier to get at.

In use, a user climbs onto the mattress on the lower bunk. Another user may climb onto the mattress on the upper bunk by climbing up the ladder. A user may also play with the entertainment device by removing the entertainment device from the depression of the support member and depressing the buttons so that the entertainment device emits the prerecorded messages.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bunk bed assembly, comprising:

a plurality of generally vertically extending elongate columns being spaced apart and oriented in a generally rectangular configuration;

each of said columns having upper and lower ends and a transparent peripheral sidewall extending between said ends, said peripheral sidewall of each of said columns defining a bore through said column; and a pair of spaced apart upper and lower bunks extending between said columns.

2. The bunk bed assembly of claim 1, wherein each of said columns is generally cylindrical, said peripheral sidewall of each of said columns having a plurality of equally spaced annular recessions being positioned between said ends of said column.

3. The bunk bed assembly of claim 1, wherein each of said columns has a plurality of spaced apart shelves disposed in said bore thereof, each of said columns having a plurality of stuffed dolls therein resting on said shelves.

4. The bunk bed assembly of claim 1, wherein one of said sides of each of said bunks has a pair of generally rectangular slots therethrough, a plurality of drawers slidably extending through said slots of said sides of said bunks.

5. The bunk bed assembly of claim 1, further comprising a pair of mattress housings resting on support panels of said bunks, each of said mattress housings having a base panel and a peripheral flange upwardly extending from said base panel, a pair of mattresses resting on said base panels of said mattress housings.

6. The bunk bed assembly of claim 5, wherein said peripheral flanges extend around a lower ⅔ of a side edge of each of said mattresses.

7. The bunk bed assembly of claim 5, wherein each of said mattress housings comprises a light resilient polystyrene plastic inner portion.

8. The bunk bed assembly of claim 1, further comprising an elongate bunk rail extending between said upper ends of a pair of said columns adjacent one of said sides of said upper bunk, said bunk rail being wavy.

9. The bunk bed assembly of claim 1, further comprising a plurality of translucent light housings being coupled to said upper ends of said columns, each of said light housings having a light bulb disposed therein.

10. The bunk bed assembly of claim 9, wherein each of said light housings have a switch extending therethrough and being in electrical communication with a power source, each of said light bulbs being in communication with said switch of the associated light housing.

11. The bunk bed assembly of claim 1, wherein each of said light bulbs comprises a fluorescent light.

12. The bunk bed assembly of claim 1, further comprising at least one support member extending between adjacent columns positioned towards said ends of said bunks, said support member having a depression therein, an entertainment device being removably disposed in said depression of said support member.

13. The bunk bed assembly of claim 12, wherein said entertainment device has a voice synthesizer and a speaker in communication with said voice synthesizer, said voice synthesizer and speaker being for emitting a plurality of prerecorded messages.

14. The bunk bed assembly of claim 13, wherein said entertainment device has a plurality of buttons in communication with said voice synthesizer, each of said buttons corresponding to a unique prerecorded message, wherein one of said prerecorded messages is emitted when the associated button is depressed.

15. A bunk bed assembly, comprising:

a plurality of generally vertically extending elongate columns being spaced apart and oriented in a generally rectangular configuration;

each of said columns having upper and lower ends and a transparent peripheral sidewall extending between said ends, said peripheral sidewall of each of said columns defining a bore through said column;

a pair of spaced apart upper and lower bunks extending between said columns, each of said bunks being generally rectangular;

a pair of mattresses resting on said bunks;

a ladder being coupled to said upper bunk;

each of said columns being generally cylindrical;

said peripheral sidewall of each of said columns having a plurality of equally spaced annular recessions being positioned between said ends of said column;

each of said columns having a plurality of spaced apart shelves disposed in said bore thereof;

each of said columns having a plurality of stuffed dolls therein resting on said shelves;

each of said columns having a generally cylindrical base portion extending from said lower end thereof;

each of said bunks having a pair of opposite sides, a pair of ends extending between said sides, and a support panel extending between said sides and ends of said bunk;

each of said support panels being positioned between upper and lower edges of said sides and ends of the associated bunk;

each of said bunks having a plurality of cross members extending between said sides of said bunks, said cross members abutting a lower surface of said support panel of the associated bunk;

one of said sides of each of said bunks having a pair of generally rectangular slots therethrough;

a plurality of drawers slidably extending through said slots of said sides of said bunks and between an adjacent pair of said cross members of said bunks;

a pair of mattress housings resting on said support panels, each of said mattress housings having a base panel and a peripheral flange upwardly extending from said base panel, said mattresses resting on said base panels of said mattress housings, said peripheral flanges extending around a lower ⅔ of a side edge of each of said mattresses;

each of said mattress housings comprising a light resilient polystyrene plastic inner portion and a rubber outer covering;

an elongate bunk rail extending between said upper ends of a pair of said columns adjacent one of said sides of said upper bunk;

said bunk rail being wavy;

said bunk rail having a resiliently deformable rubber coating;

a plurality of translucent light housings, each of said light housings having a top panel and a perimeter sidewall downwardly extending from said top panel, said perimeter sidewalls being threadedly coupled to said upper ends of said columns;

each of said top panels of said light housings having a switch extending therethrough and being in electrical communication with a power source;

each of said light housings having a light bulb disposed therein, each of said light bulbs being in communication with said switch of the associated light housing;

wherein each of said light bulbs comprises a fluorescent light;

a plurality of support members extending between adjacent columns positioned towards said ends of said bunks;

each of said support members having a plurality of equally spaced annular recessions being positioned between opposite ends of said support member;

one of said support members having a depression therein and an aperture extending through said support member and positioned in said depression;

an entertainment device being removably disposed in said depression of said support member;

a power cord extending through said aperture of said support member, said entertainment device being in electrical communication with said power cord;

said entertainment device having a voice synthesizer and a speaker in communication with said voice synthesizer, said voice synthesizer and speaker being for emitting a plurality of prerecorded messages;

said entertainment device having a plurality of buttons in communication with said voice synthesizer, each of said buttons corresponding to a unique prerecorded message, wherein one of said prerecorded messages is emitted when the associated button is depressed;

said entertainment device having a power switch being electrically connected to said power cord and said voice synthesizer; and said depression of said support member facing an adjacent said bunk.

* * * * *